US009728354B2

(12) United States Patent
Skolozdra et al.

(10) Patent No.: US 9,728,354 B2
(45) Date of Patent: Aug. 8, 2017

(54) ISOLATING GROUND SWITCH

(71) Applicants: Stephen A. Skolozdra, Terryville, CT (US); John K. Carrozzo, Torrington, CT (US)

(72) Inventors: Stephen A. Skolozdra, Terryville, CT (US); John K. Carrozzo, Torrington, CT (US)

(73) Assignee: Electric Motion Company, Inc., Winsted, CT (US)

( * ) Notice: Subject to any disclaimer, the term of this patent is extended or adjusted under 35 U.S.C. 154(b) by 173 days.

(21) Appl. No.: 14/540,098

(22) Filed: Nov. 13, 2014

(65) Prior Publication Data

US 2015/0144468 A1 May 28, 2015

Related U.S. Application Data

(60) Provisional application No. 61/908,923, filed on Nov. 26, 2013.

(51) Int. Cl.

| | |
|---|---|
| ***H01H 15/00*** | (2006.01) |
| ***H01H 15/10*** | (2006.01) |
| ***H01H 19/635*** | (2006.01) |
| ***H01H 15/06*** | (2006.01) |
| ***H01H 31/00*** | (2006.01) |

(Continued)

(52) U.S. Cl.

CPC ..... *H01H 15/06* (2013.01); *H01H 31/003* (2013.01); *H01R 4/66* (2013.01); *H01R 31/085* (2013.01); *H01R 11/09* (2013.01)

(58) Field of Classification Search

CPC ..... H01H 2059/0027; H01H 2239/018; H01H 15/00; H01H 15/10; H01H 19/635; H01H 1/00; H01H 1/06; H01H 1/12; H01H 1/20; H01H 1/24; H01H 1/26; H01H 1/40; H01H 1/42; H01H 1/58; H01H 2001/00; H01H 2201/00; H01H 2203/00; H01H 2203/034; H01H 2203/04; H01H 2207/00; H01H 2207/016; H01H 2207/022; H01H 2207/036

USPC ..... 200/16 R, 5 R, 5 SG, 6, 40 CC, 51, 521, 200/50, 50.51, 50.59, 527, 549; 361/1, 3, 361/42, 622, 629, 823; 174/5 R, 5 SG, 6, 174/40 CC, 51, 521, 50, 50.51, 50.59, 174/527, 549

See application file for complete search history.

(56) References Cited

U.S. PATENT DOCUMENTS 1,537,272 A * 5/1925 Sweet ..... H01H 15/02 200/15

4,779,305 A * 10/1988 Gorsek ..... G05G 1/082 16/441

(Continued)

*Primary Examiner* — Edwin A. Leon
*Assistant Examiner* — Anthony R. Jimenez
(74) *Attorney, Agent, or Firm* — Alix, Yale & Ristas, LLP

(57) ABSTRACT

An isolating ground switch includes an enclosure with a frontal surface. A slide channel opens through the top of the enclosure. A conductive switch plate is received in the channel and is bi-directionally slidably positionable between the first position and the second position. A plurality of terminal studs project forwardly from the frontal surface of the enclosure and rearwardly conductively communicate with a conductive portion. When the switch plate is in the first position, the conductive portion engages the switch plate. When the switch plate is in the second position, the conductive portion is isolated from the switch plate.

20 Claims, 11 Drawing Sheets

(51) Int. Cl.

| | |
|---|---|
| ***H01R 4/66*** | (2006.01) |
| ***H01R 31/08*** | (2006.01) |
| *H01R 11/09* | (2006.01) |

(56) References Cited

U.S. PATENT DOCUMENTS 7,429,710 B2 * 9/2008 Gutalj ..... H02B 13/075
218/55
8,647,159 B2 * 2/2014 Steeves ..... H01R 4/305
439/798

* cited by examiner

ISOLATING GROUND SWITCH

BACKGROUND

This disclosure relates generally to devices for bonding and grounding various terminals. More particularly, this disclosure relates generally to devices and methods for grounding multiple harnesses and isolating the harnesses for testing.

It is common to bond harnesses for an electrically conductive line at a terminal and to provide a ground connection. Such terminals are located at or in utility marker posts, pedestals, cabinets, manholes, vaults and enclosures. The lines may serve as communication lines or markers for water lines, gas lines and power lines. Numerous devices and techniques have been advanced for implementing the required bonding and grounding.

When a specific line is to be tested, it is necessary to isolate the line. Conventional isolation of the lines typically requires that the connections be removed for the various lines to be tested and for the connections to be reattached after the testing to ensure the proper bonding and grounding. The conventional methods are inefficient and furthermore are often problematic when the bonding is not properly connected after the testing is complete. If each of the lines or multiple lines are to be tested, then each of the harnesses must be disconnected and properly reconnected.

SUMMARY

Briefly stated, an isolating ground switch in a preferred form comprises an enclosure having a frontal surface and a top. A side channel opens through the top. A conductive switch plate is received in the channel. The switch plate is bi-directionally slidably positioned between first and second positions. Terminal assemblies are mounted to the enclosure. Each terminal assembly includes a terminal stud projecting forwardly from the frontal surface. Each terminal stud also rearwardly conductively communicates with a conductive portion. When the switch plate is in a first position, each conductive portion conductively engages the switch plate. When the switch plate is in a second position, each conductive portion is conductively isolated from the switch plate. A ground connector conductively connects a terminal stud.

In one embodiment, the switch plate is bent forwardly to form a handle. The enclosure and the switch plate further have mounting openings at laterally spaced locations. The switch plate further has an array of openings located to correspond to the location of the terminal studs. The openings of the array are substantially identical and include an enlarged portion and a reduced portion.

In the second position, each conductive portion does not engage portions of the switch plate defining the openings, and in the first position, the conductive portion engages portions surrounding the reduced portion of the opening. Each terminal stud preferably comprises a threaded locate stud and a hex collar. The enclosure frontal surface defines an array of hex sockets which receive each hex collar. The conductive portion further comprises a screw which threads into the terminal stud. The enclosure is affixed with indicia indicating a direction for isolating and a direction for grounding. A mounting structure and a pair of fasteners extend through the mounting openings to mount the switch to a mounting structure.

The isolating ground switch preferably comprises an enclosure having a frontal surface and a side and a slide channel opening through the side. A conductive switch plate is received in the channel and slidably positionable between a first position and a second position. The switch plate has a plurality of plate openings. Terminal studs are mounted to the enclosure and project forwardly from the frontal surface. Each of the terminal studs rearwardly conductively communicates with a conductive unit. When the switch plate is in the first position, each conductive unit conductively engages the switch plate. When the switch plate is in a second position, each conductive unit is fully located in an opening and conductively isolated from the switch plate. A ground connector is conductively communicable with the slide plate.

The switch plate is preferably bent forwardly to form a handle. The enclosure and the switch plate further have mounting through openings at laterally spaced locations. A mounting structure and a pair of fasteners extend through the mounting openings to mount the switch to a mounting structure. The switch plate openings are substantially identical and include enlarged and reduced portions. In the second position, each conductive unit does not engage portions of the switch plate which define the plate openings. In the first position, the conductive assembly engages portions surrounding the reduced portions of the openings. The enclosure is preferably affixed with indicia indicating a direction for isolating and a direction for grounding.

An isolating ground switch comprises an enclosure with a frontal surface and a top and a slide channel opening through the top. A conductive switch plate is received in the channel and is slidably positionable from a first position to a second position. The switch plate has an upper handle. Threaded terminal studs are mounted to the enclosure and project forwardly from the frontal surface. Each of the terminal studs rearwardly conductively communicates with a conductive unit. When the switch plate is in the first position, each conductive unit conductively engages the switch plate. When the switch plate is in the second position, each conductive assembly is conductively isolated from the switch plate. A ground connector conductively communicates with each terminal stud. The switch plate further has an array of openings which are located to correspond to the location of the terminal studs. The openings are preferably substantially identical and include an enlarged portion and a reduced portion.

DETAILED DESCRIPTION

Figure 1:
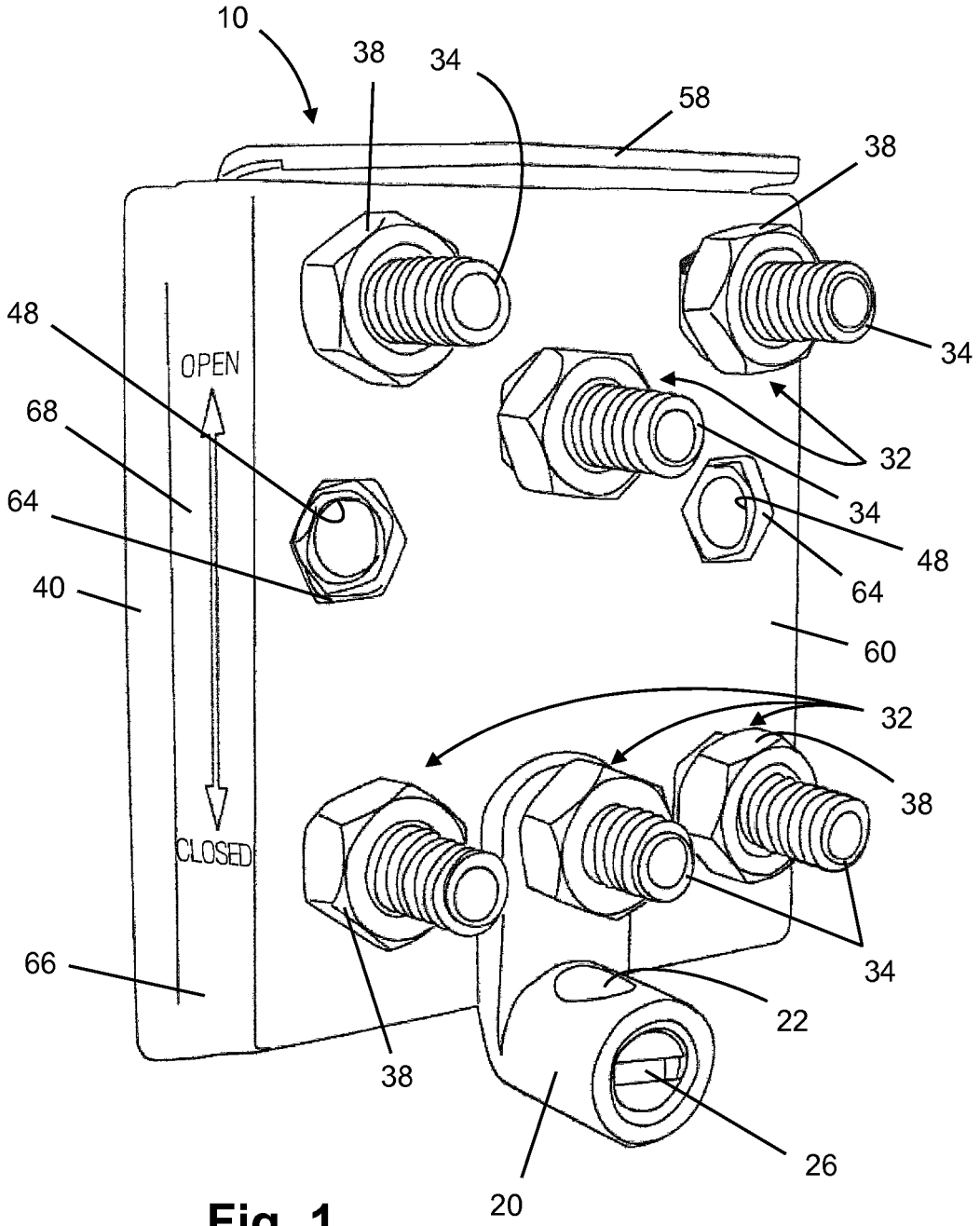
FIG. 1 is a generally front perspective view of an isolating ground switch.
Figure 2:
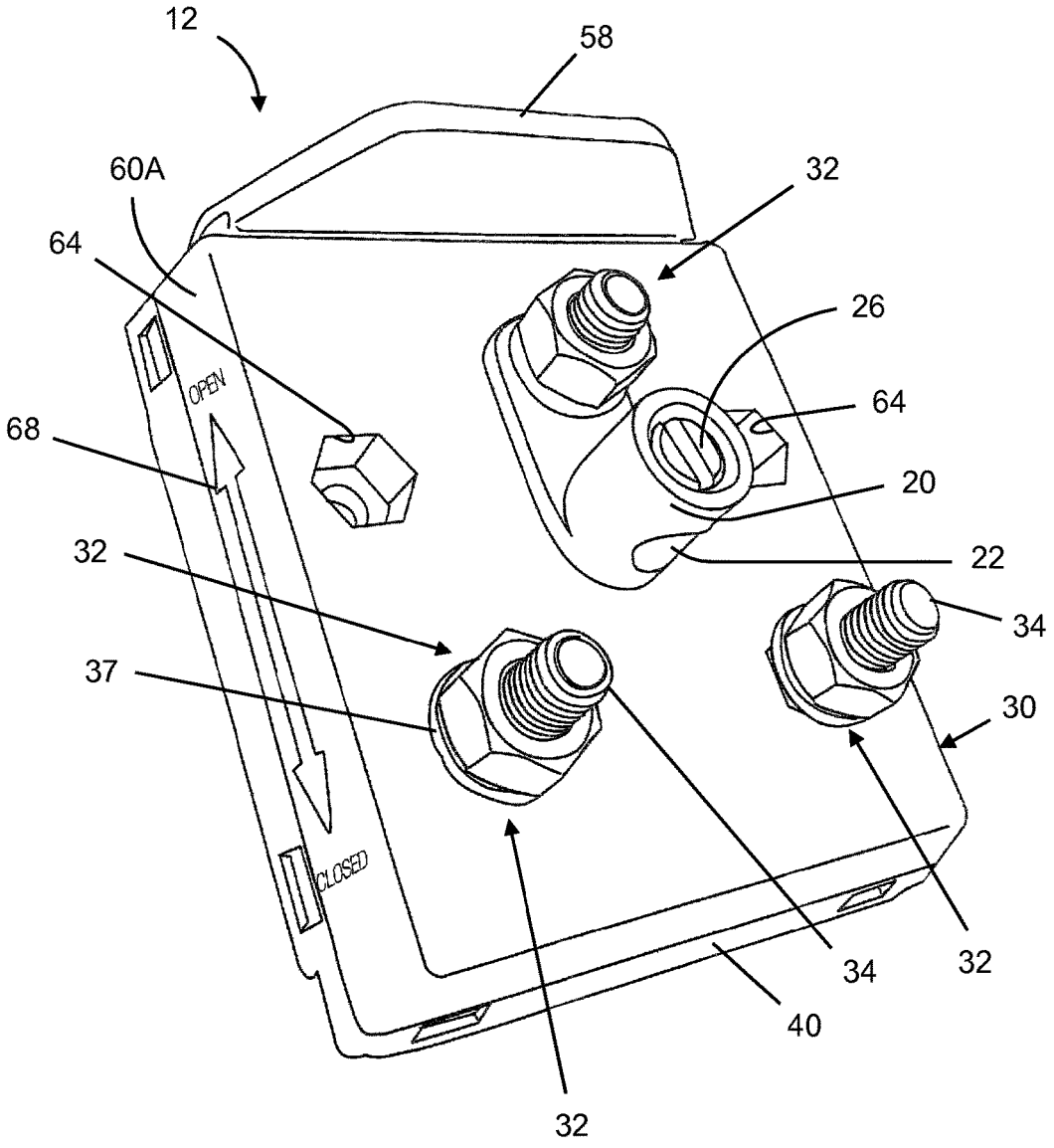
FIG. 2 is a generally front view of another embodiment of an isolating ground switch.
Figure 3:
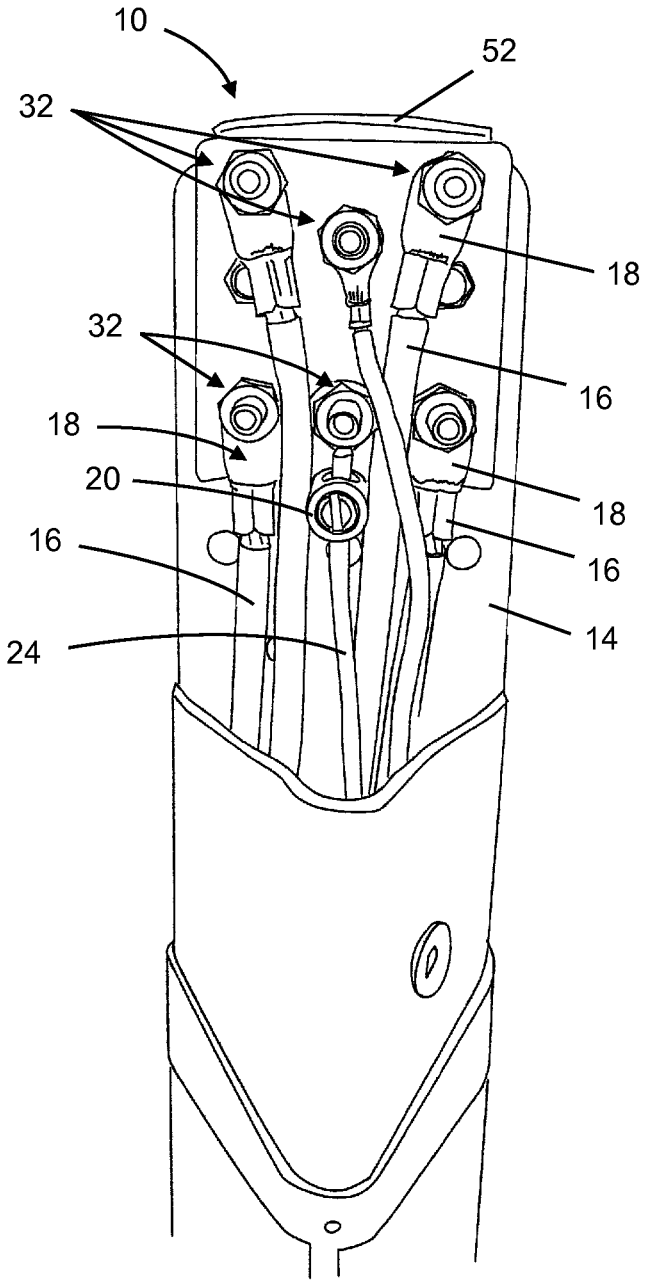
FIG. 3 is a front view of the isolating ground switch of FIG. 1 together with connected bonding harnesses and illustrated in a grounding mode and mounted to a utility marker post.
Figure 4:
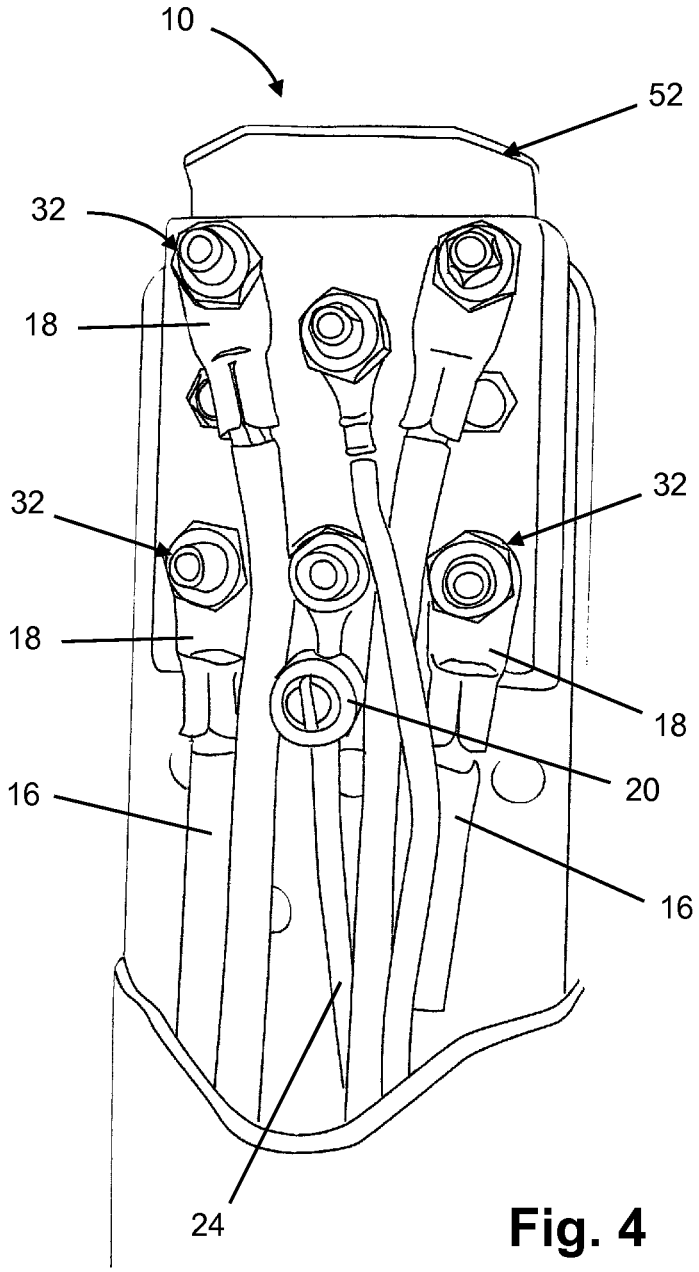
FIG. 4 is a front view of the isolating ground switch, marker post and harnesses of FIG. 3 configured in an isolated mode.
Figure 5:
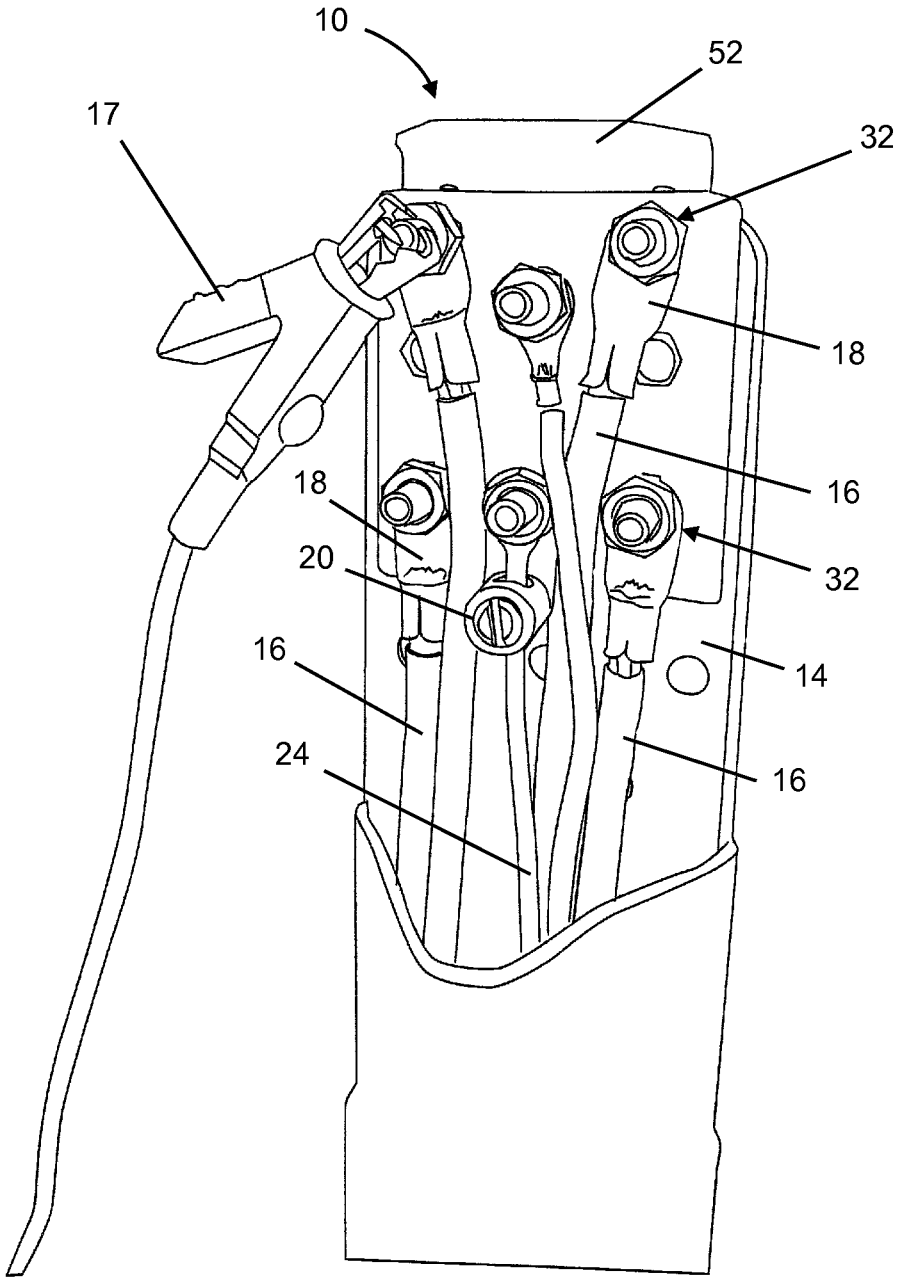
FIG. 5 is a front view of the isolating ground switch, marker post and harnesses of FIG. 4 together with a test transmitter clip.

With reference to the drawings wherein like numerals represent like parts throughout the several figures, an isolating ground switch is generally designated by the numeral 10 for a six-position isolating ground plate (FIG. 1), and by the numeral 12 for a three-position isolating ground plate (FIG. 2). With reference to FIGS. 3-5, the isolating ground switches 10 and 12 are adapted to mount to marker posts 14 or other structures and to provide an efficient bi-stable ground switch which permits multiple lines 16 each having a bonding harness 18 to be either concurrently isolated (FIG. 4) or to be concurrently connected to ground (FIG. 3) in an efficient, user-friendly process while maintaining the bonding harnesses in a connected state.

The isolating ground switches 10 and 12 are adapted to connect with multiple bonding harnesses 18 and provide a ground connection via a ground lug 20. The ground lug 20 has an opening 22 which receives a #6 to #24 AWG ground wire 24 secured in position by a set screw 26.

Figure 8:
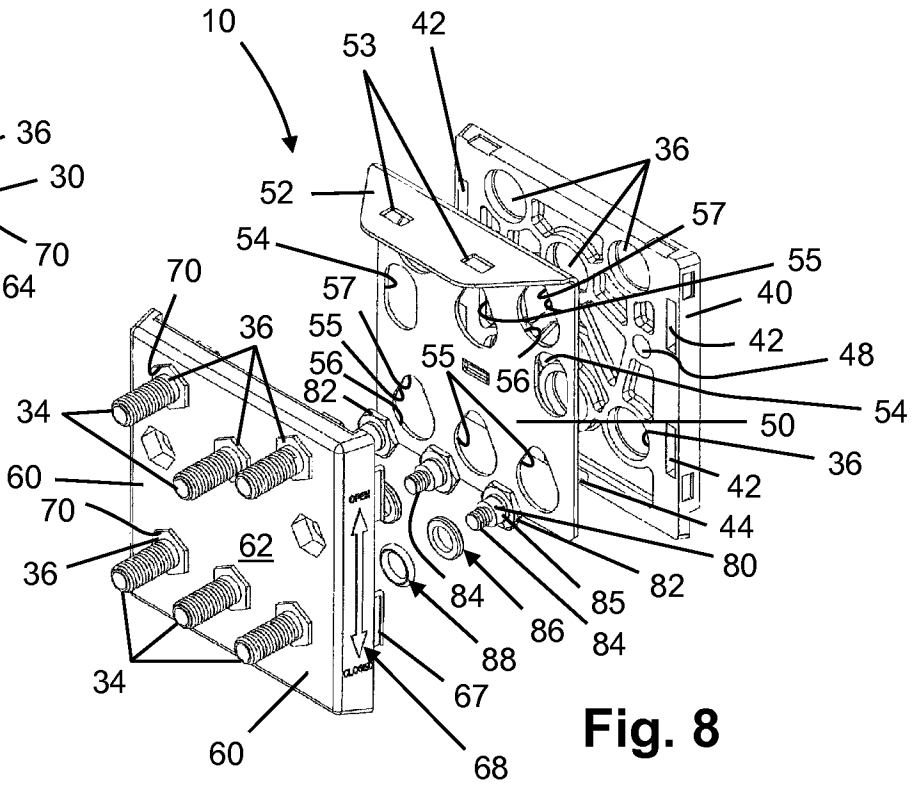
FIG. 8 is an exploded perspective view of the isolating ground switch of FIG. 7.
Figure 7:
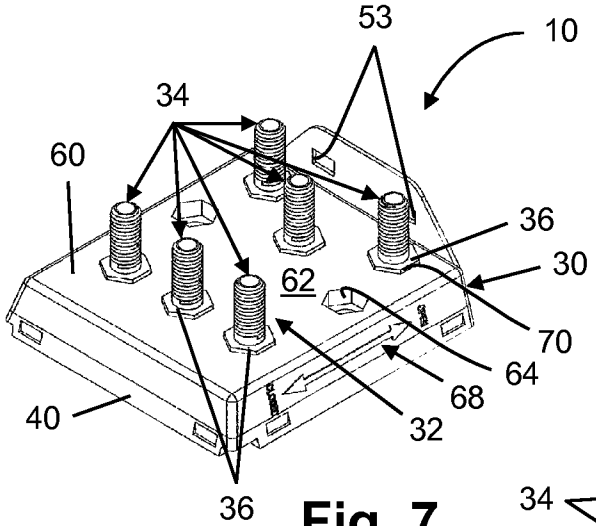
FIG. 7 is a perspective view of the isolating ground switch of FIG. 1 in a partially assembled state.
Figure 9:
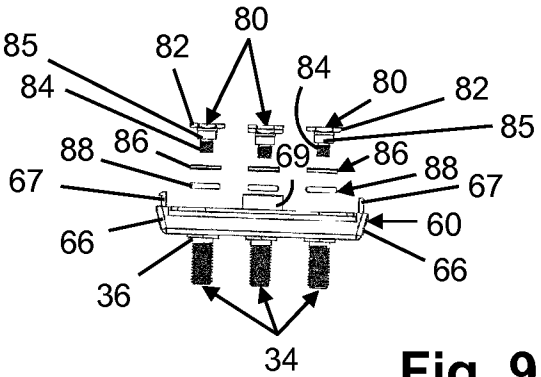
FIG. 9 is a reversed bottom exploded view of the isolating ground switch of FIG. 7 in a partially assembled state.

The isolating ground switch 10 preferably comprises a compact, substantially rectangular enclosure 30 having a base 40 and a snap-fit cover 60. The enclosure 30 is formed from a rugged non-conductive material. An intermediate sliding switch plate 50 (FIG. 8) is received between the base 40 and the cover 60 and is manually reciprocated to provide the bonding and isolating functions. An array of parallel terminal connectors 32 preferably comprise threaded locate studs 34 having hex collars 36. The studs 34 extend forwardly from the enclosure for bonding via a nut 38 with a bonding harness 18.

The base 40 is preferably a substantially rectangular molded member formed of 10% glass filled polycarbonate Lexan™ material. The base 40 has a pair of laterally spaced slots 42 adjacent opposed sides and a bottom slot 44. For isolating switch 10, six shallow circular wells 46 are formed in the base for receiving terminal hardware, as will be described below. The base 40 also includes a pair of opposed openings 48 which function as a part of a throughbore for securing the base to a mounting post or other structure.

Figure 6:
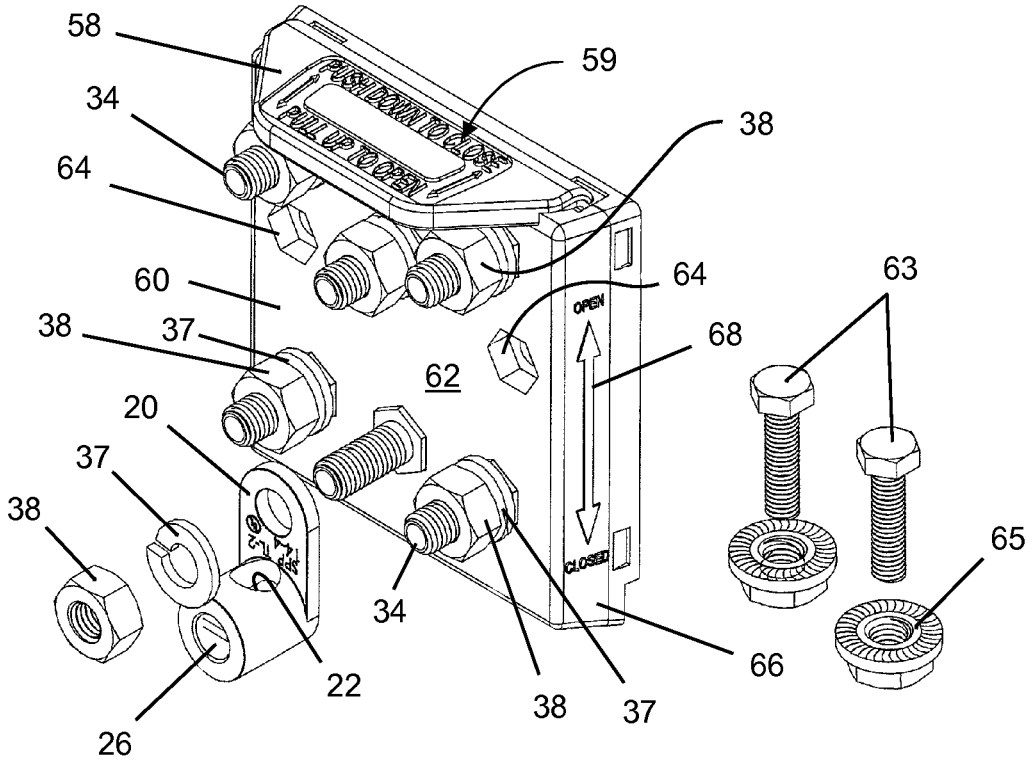
FIG. 6 is a partially exploded perspective view of the isolating ground switch of FIG. 1.

The ground switch plate 50 is preferably a brass member which is bent forwardly at an upper end to form a substantially L-shaped section. The upper end 52 functions as a handle. The plate 50 includes a pair of laterally spaced oblong slots 54 which generally align with the openings 48 in the base, as will be further described. The plate 50 includes substantially identical quasi-keyhole-type openings 55 having an enlarged portion 56 and an upper reduced portion 57. The openings 55 generally align with the wells 46 of the base, as will be further described. In one form, a rubber material 58 covers the handle portion to provide an enhanced grip of the handle. In this regard, a pair of rectangular openings 53 may be formed to anchor the grip. The upper surface of the handle may be affixed with indicia 59 (FIG. 6) which briefly indicates the switch plate 50 operation.

The cover 60 is preferably a substantially rectangular molded member formed from 10% glass filled polycarbonate Lexan™ material. The cover 60 has a frontal face 62 which includes laterally spaced hex-shaped openings 64 that generally align with the plate oblong slots 54 (to accommodate the sliding of the plate 50) and the base openings 48 to provide continuous throughbores. The throughbores receive fasteners (FIGS. 3-6) secured by nuts 65 for mounting the isolating ground switch to a structure. The cover also includes hex sockets 70 (partially illustrated), as will be further described. The hex sockets 70 generally align with the keyhole openings 55 of the grounding plate and the wells 46 in the base. The hex sockets 70 each closely receive a hex collar 36 of a locate stud 34.

The cover includes side skirts 66 having rearwardly projecting resilient tabs 67 which engage in the side slots 42 of the base. In addition, there is a bottom tab 69 which resiliently engages in the bottom slot 44 of the base. One or both of the side skirts may be affixed with an arrow and indicia 68 indicating the ground and isolating directions for the slidably received switch plate 50.

Substantially identical locate backing screws 80 each have a head 82 with a diametric dimension which is less than that of the wells 46. The heads 82 are received in corresponding wells 46. The forward portion 84 of the backing screw is threaded and extends from an enlarged intermediate portion 85 which receives a floating washer 86 and an O-ring 88. The forward threaded portion 84 threads into the rear of a locate stud 34. Each hex collar 36 is closely received in a hex socket 70 of the cover and is fixed against rotation therewith. The threaded portion 84 of the locate backing screw threads into the locate stud to complete a conductive path. It will be appreciated that the locate studs 34 each connect to a bonding harness 18 and includes and typically mounts a lock washer 37 and a hex nut 38 for securing the harness connection.

The cover 60 snaps over the base 40 to form the enclosure 30 and a channel to capture the intermediately received sliding switch plate 50. Upon normal force applied to the upper end or handle 52, the switch plate 50 selectively reciprocates upwardly and downwardly between an isolated and a grounded position, as indicated in the drawings. The back of the plate 50 slides above the heads 82. In a fully upward locate mode for the ground plate relative to the cover and base, the heads 82 of the locate backing screw are received in the wells 46, and the carried floating washers 86 and O-rings 88 remain in a non-contact electrically isolated position within the corresponding enlarged portions 56 of the keyhole slots 55 of the switch plate 50. Therefore, there is no electrical connection between the locate studs 32 and the locate screws 80, washer 86 or O-rings 88. When the ground plate 50 is forced downwardly to the grounding mode, the plate portion defining the reduced portions 57 of the slots engage the floating washer 86 and the O-rings 88 to establish conductive or electrical communication with the locate studs 34 and essentially provide a grounding function for the bonded harnesses 18.

Figure 10:
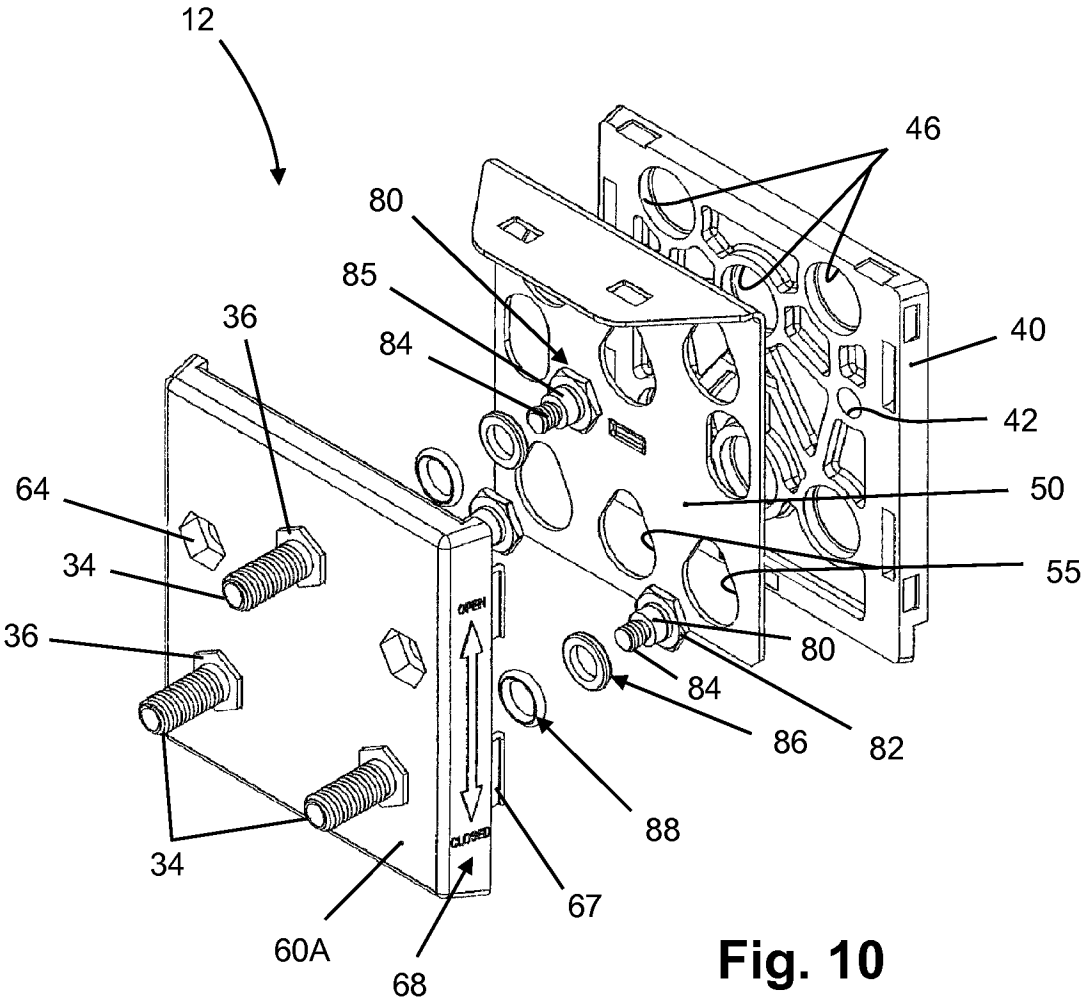
FIG. 10 is a perspective exploded view of the isolating ground switch of FIG. 2 in a partially assembled state.

For the three terminal isolated ground plate 12 (FIGS. 2 and 10), the cover plate 60A is modified to define three hex sockets 70 and accept three terminal connectors 32.

It will be appreciated that the position of the switch plate 50 will either isolate the various lines, which connect via the bonding harnesses, or will ground each of the lines. Consequently, when it is desired to test a line, the line may be isolated in an efficient manner without disconnecting the corresponding harness. A test clip 17 (FIG. 5) may be attached to the terminal 32. Typically, a distinctive tone is transmitted along the line 16. After testing, the line along with the other lines may be restored to the grounding function by manually forcing the switch plate 50 downwardly. The ground lug 20 is typically connected to one of the locate studs 34. Other ground connectors are also possible. In addition, the isolating ground switch 10 or 12 provides a well-defined, easily observed indication of whether the terminal is in a bi-stable isolated or a grounded mode.

Figure 11A:
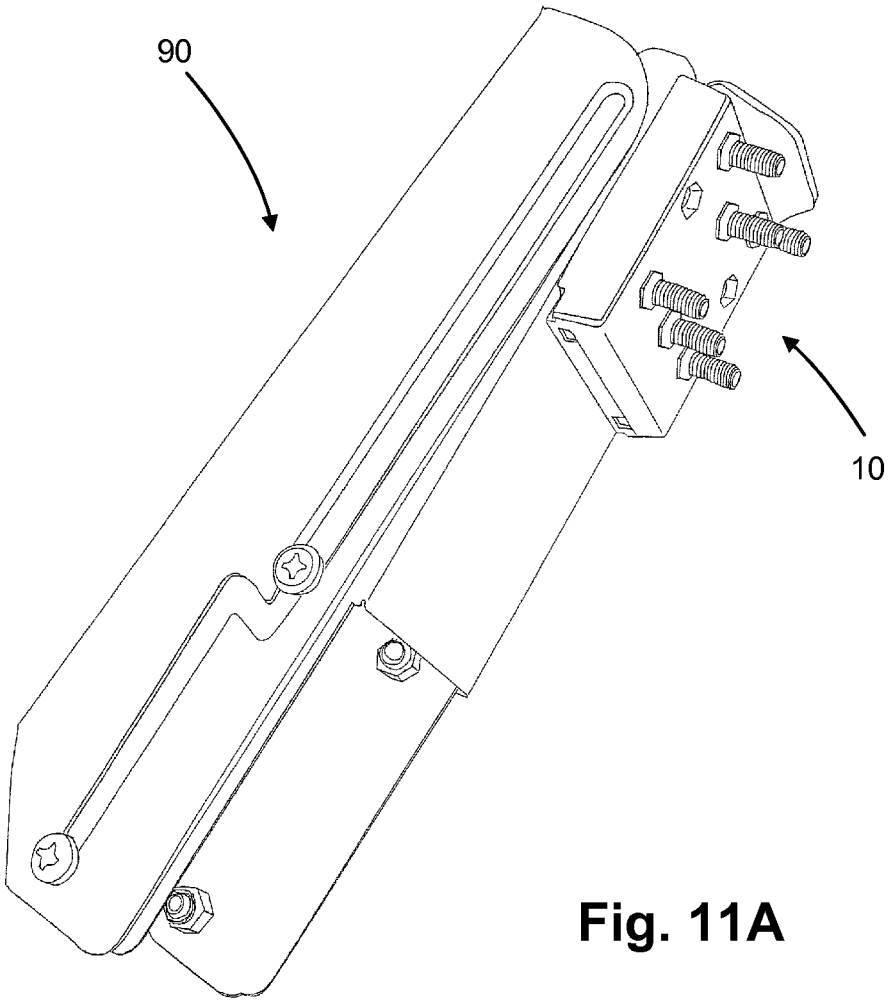
FIGS. 11A, 11B and 11C are perspective views of the isolating ground switch of FIG. 1 mounted to a displaceable arm mount, such as may be employed in a below ground location, and illustrating retracted, intermediate and elevated positions, respectively.
Figure 11B:
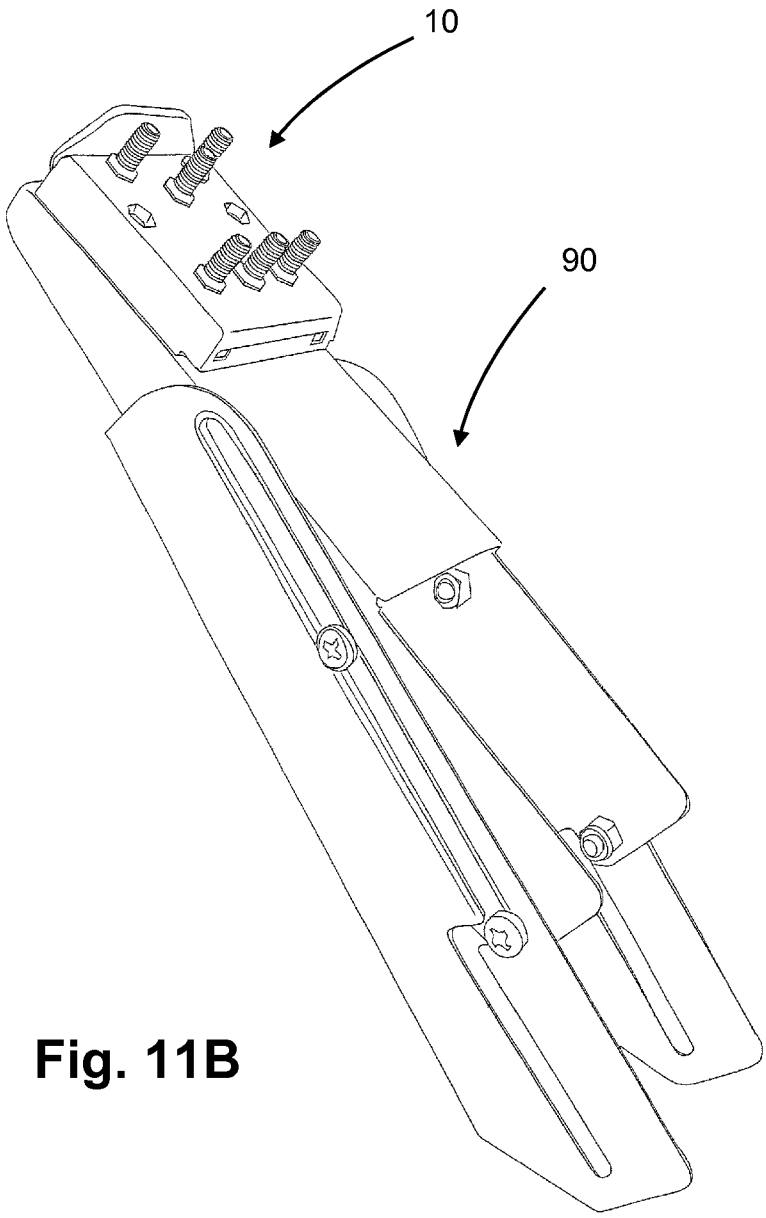
Figure 11C:
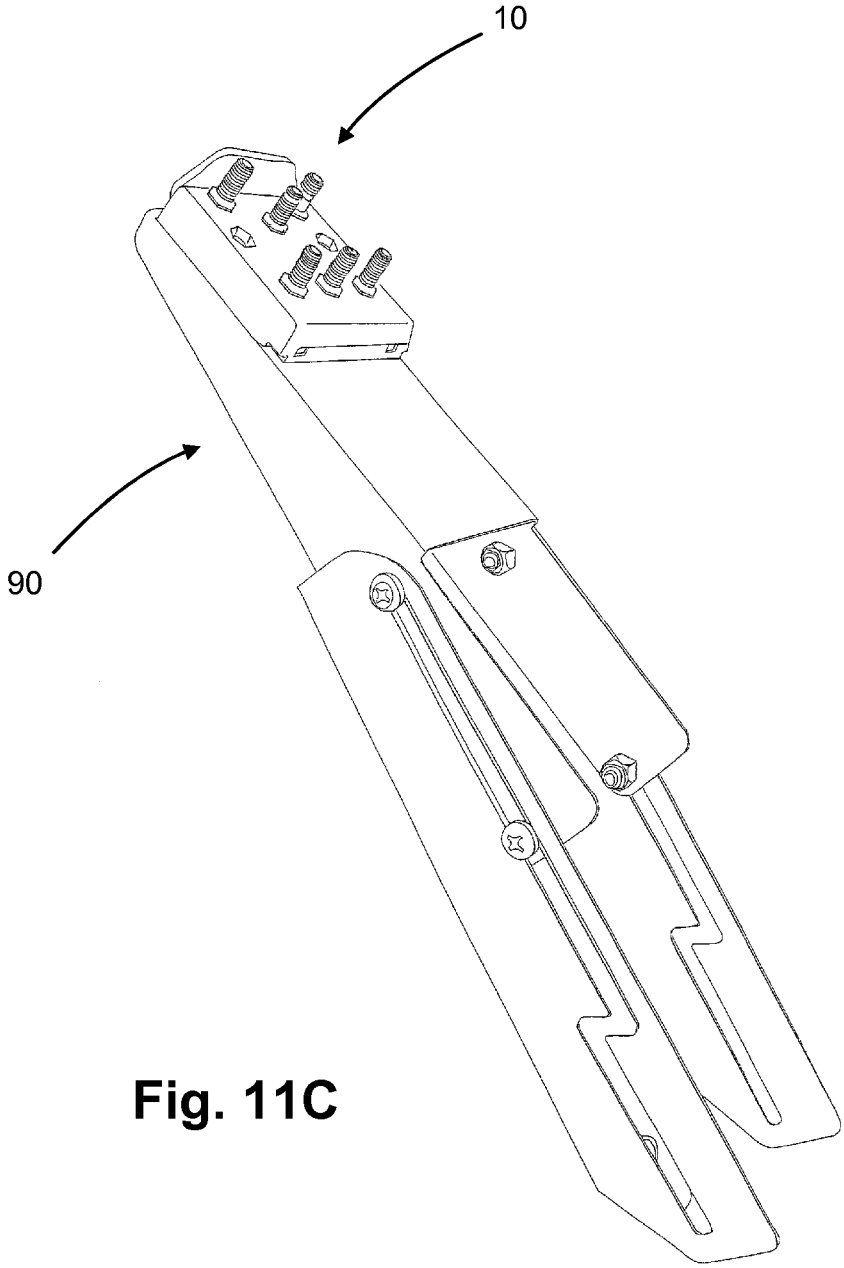

In one preferred application as indicated in FIGS. 11A-11C, isolated grounding plate 10 is mounted to a displaceable bracket 90. An access cover may cover a below ground terminal assembly. The cover is not illustrated. When the cover is opened, the grounding plate 10 is upwardly pulled and simultaneously transformed from the grounding position (FIG. 11A) to the isolated position (FIG. 11C) so that testing may be accomplished. When the cover is returned, the grounding plate 10 is forced downwardly to ensure both a proper below ground position and the grounding of the various lines.

It will be appreciated that various conductive lines may be provided to provide a waterline mark, a gas line mark and various communication or power line indicators. In preferred embodiments, the tints of the base 40 and the cover 60 indicate the preferred application, such as yellow for a gas line, blue for a water line, orange for communication lines and red for a power line. Naturally, the number of actual terminals 32 or locate studs 34 may be varied from, for example, a six locate stud configuration and a three locate stud configuration illustrated in FIGS. 1 and 2, respectively.

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit and the scope of the invention.

The invention claimed is:

1. An isolating ground switch comprising:

an enclosure having a frontal surface and a top and defining a slide channel opening through the top;

a conductive switch plate received in said channel and slidably positionable in a displacement plane between a first position and a second position, said switch plate having a plate portion displaceable in said displacement plane and defining an array of openings which are displaceable in said displacement plane;

a plurality of terminal assemblies each mounted to said enclosure and comprising a terminal stud projecting forwardly from said frontal surface and rearwardly conductively communicating with a conductive portion;

wherein when said switch plate is in said first position, each said conductive portion conductively engages said switch plate in portions defining said openings and when said switch plate is in the second position, each said conductive portion does not engage portions defining said openings and is conductively isolated from said switch plate; and a ground connector conductively connecting a terminal stud.

2. The switch of claim 1 wherein the switch plate is bent forwardly to form a handle.

3. The switch of claim 1 wherein said enclosure is affixed with indicia indicting a direction to open and a direction to close.

4. The switch of claim 1 wherein said enclosure and said switch plate further define through openings at laterally spaced locations thereof.

5. The switch of claim 4 further comprising a mounting structure and a pair of fasteners which extend through said through openings to mount said switch to said mounting structure.

6. The switch of claim 1 wherein said array of openings are located to correspond to the location of said terminal studs.

7. The switch of claim 6 wherein said openings of said array are substantially identical and include an enlarged portion and a reduced portion.

8. The switch of claim 7 wherein in the second position, each said conductive portion does not engage portions of said switch plate defining said openings and in said first position, said conductive portion engages portions surrounding said reduced portions of said opening.

9. The switch of claim 1 wherein each said terminal stud comprises a threaded locate stud and a hex collar and said enclosure frontal surface defines an array of hex sockets which receive each said hex collar.

10. The switch of claim 9 wherein said conductive portion further comprises a screw which threads into the terminal stud.

11. An isolating ground switch comprising:

an enclosure having a frontal surface and a side and defining a slide channel opening through the side;

a conductive switch plate received in said channel and bi-directionally positionable between a first position and a second position which are displaceable as said switch plate moves between said first position and said second position, said switch plate having a plate portion generally parallel to said frontal surface, said plate portion defining a plurality of openings;

a plurality of terminal studs mounted to said enclosure and projecting forwardly from said frontal surface and each rearwardly conductively communicating with a conductive unit;

wherein when said switch plate is in said first position, each said conductive unit conductively engages said switch plate and when said switch plate is in the second position, each said conductive unit is fully located in an opening and conductively isolated from said switch plate; and a ground connector conductively communicable with said slide plate.

12. The switch of claim 11 wherein the switch plate is bent forwardly to form a handle.

13. The switch of claim 11 wherein said enclosure and said switch plate further comprise through openings at laterally spaced locations thereof.

14. The switch of claim 11 further comprising a mounting structure and a pair of fasteners which extend through said through openings to mount said switch to said mounting structure.

15. The switch of claim 11 wherein said enclosure is affixed with indicia indicting a direction to close and a direction to open.

16. The switch of claim 11 wherein said openings are substantially identical and include an enlarged portion and a reduced portion.

17. The switch of claim 16 wherein when the switch plate is in the second position, each said conductive unit does not engage portions of said switch plate defining said openings and when the switch plate is in said first position, said conductive assembly engages portions surrounding said reduced portions of said opening.

18. An isolating ground switch comprising:

an enclosure having a frontal surface and a top and defining a slide channel opening through the top;

said switch plate having an array of openings which include an enlarged portion and a reduced portion;

a conductive switch plate received in said channel and bi-directionally slidably positionable between a first position and a second position and having an upper handle;

a plurality of threaded terminal studs mounted to said enclosure and projecting forwardly from said frontal surface and each of said terminal studs rearwardly conductively communicating with a conductive unit; and wherein when said switch plate is in said first position, each said conductive portion engages portions surrounding said reduced portions of each said opening, and each said conductive unit conductively engages said switch plate and when said switch plate is in the second position, each said conductive unit is conductively isolated from said switch plate.

19. The switch of claim 18 wherein said switch plate further comprises an array of openings which are located to correspond to the location of said terminal studs.

20. The switch of claim 19 wherein said openings are substantially identical.

* * * * *